US007159501B1

(12) United States Patent
Ansay et al.

(10) Patent No.: US 7,159,501 B1
(45) Date of Patent: Jan. 9, 2007

(54) STACKABLE IN-LINE SURFACE MISSILE LAUNCH SYSTEM FOR A MODULAR PAYLOAD BAY

(75) Inventors: Michael T. Ansay, Johnston, RI (US); Harry Zervas, Lincoln, RI (US); Michael J. Wroblewski, Portsmouth, RI (US); James T. Broadmeadow, Seekonk, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 42 days.

(21) Appl. No.: 10/985,084

(22) Filed: Nov. 8, 2004

(51) Int. Cl.
*F41F 3/00* (2006.01)

(52) U.S. Cl. ..... 89/1.809; 89/1.8; 89/1.815; 114/316; 114/319

(58) Field of Classification Search ..... 89/1.8, 89/1.801, 1.804, 1.805, 1.809, 1.81, 1.815; 114/316, 318, 319, 320; 244/63
See application file for complete search history.

(56) References Cited

U.S. PATENT DOCUMENTS 3,087,386 A * 4/1963 Rung et al. ..... 89/1.81
3,088,374 A * 5/1963 Guyant et al. ..... 89/1.81
4,185,538 A * 1/1980 Barakauskas ..... 89/1.81
4,306,486 A 12/1981 Oswell
4,342,252 A 8/1982 Hagelberg et al.
4,756,226 A * 7/1988 Piesik ..... 89/1.8
5,327,809 A 7/1994 Matteson et al.
5,942,713 A 8/1999 Basak
6,125,734 A 10/2000 Yagla
6,164,179 A 12/2000 Buffman
6,283,005 B1 9/2001 Yagla et al.
6,701,819 B1 * 3/2004 Williams et al. ..... 89/1.81

* cited by examiner

*Primary Examiner*—J. Woodrow Eldred
(74) *Attorney, Agent, or Firm*—James M. Kasischke; Jean-Paul A. Nasser; Michael P. Stanley

(57) ABSTRACT

An underwater missile launch system includes one or more missile loading modules for supporting a plurality of missiles in a stackable, in-line configuration within a pressure vessel. The missiles are arranged inside the modules, which may be stacked in groups inside a single pressure vessel, or payload bay. Each module is preferably substantially identical including a common size, shape, and payload of missiles in common with the module above and below it. A one-way positioning latch is provided that prevents the upper missiles from dropping down on top of the lower missiles, while allowing the lower missiles to later pass up through the same launch tube as the upper missiles, after the upper missiles have been ejected.

18 Claims, 3 Drawing Sheets

STACKABLE IN-LINE SURFACE MISSILE LAUNCH SYSTEM FOR A MODULAR PAYLOAD BAY

STATEMENT OF GOVERNMENT INTEREST

The invention described herein may be manufactured and used by and for the Government of the United States of America for Governmental purposes without the payment of any royalties thereon or thereto.

BACKGROUND OF THE INVENTION

1. Field of the Invention

The present invention relates to an underwater launch system for launching missiles, or ariel vehicles, sensors, signals, etc. from an underwater vehicle, and more particularly a stackable, modular missile launch system for launching numerous small scale missiles from submarine payload bays.

2. Description of the Prior Art

Traditionally, submarines have been provided with the capability of launching air borne vehicles, such as missiles, both through vertical launch via specialized launch tubes on the submarine, and horizontal launch via the submarine's torpedo tubes. In some cases, the missiles are quite large, such as the Tomahawk missile, which requires sufficient support for the large warhead on deployment.

Other smaller missiles have been developed which can be used against air borne targets, such as helicopters. However, these missiles have not been deployed from submarines because of launching considerations, such as the ability to launch multiple missiles. U.S. Pat. No. 6,164,179 to Buffman discloses a submarine deployable vertical launch spar buoy for launching small air nautical vehicles from submerged vehicles or platforms.

Existing submarine missile launch systems only have the ability to launch one missile from a single missile tube. If additional missile launches are required they must be fired from other independent missile tubes. The additional missile tubes are typically positioned side-by-side, adjacent to one another. The missile tubes are not positioned above each other, because the upper missile tube would block the lower missiles from launching. The current side-by-side configuration has a low packing density because of the individually dedicated missile tubes and pressure vessels required for each missile that is to be launched.

Accordingly, there is needed in the art a weapon launching system which increases packing densities to allow submarines to carry larger payloads of missiles while being low in cost to construct and operate, reliable, easy to maintain, and safe. Preferably, the weapon launching system should also be simple in design, relatively lightweight, and compact.

SUMMARY OF THE INVENTION

The present invention is directed to an underwater missile launch system including one or more missile loading modules for supporting a plurality of missiles in a stackable, in-line configuration within a pressure vessel. The missiles are arranged inside the module, which may be installed in groups inside a single pressure vessel, or payload bay. A single modular group may be used alone, or multiple groups may be placed in a stacked arrangement, one on top of the other, two or more in height. Preferably, each module is substantially identical including a common size, shape, and payload of missiles with the module above and below it. A one-way positioning latch is provided that prevents the upper missiles from dropping down on top of the lower missiles while allowing the lower missiles to later pass up through the same launch cylinder as the upper missiles, after the upper missiles have been launched. The missile modules and missiles are enclosed within a watertight, payload pressure vessel or bay, which protects them from the ocean environment, and may preferably be launched by air flasks positioned at the base of the vessel.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DESCRIPTION OF THE PREFERRED EMBODIMENTS

Figure 1:
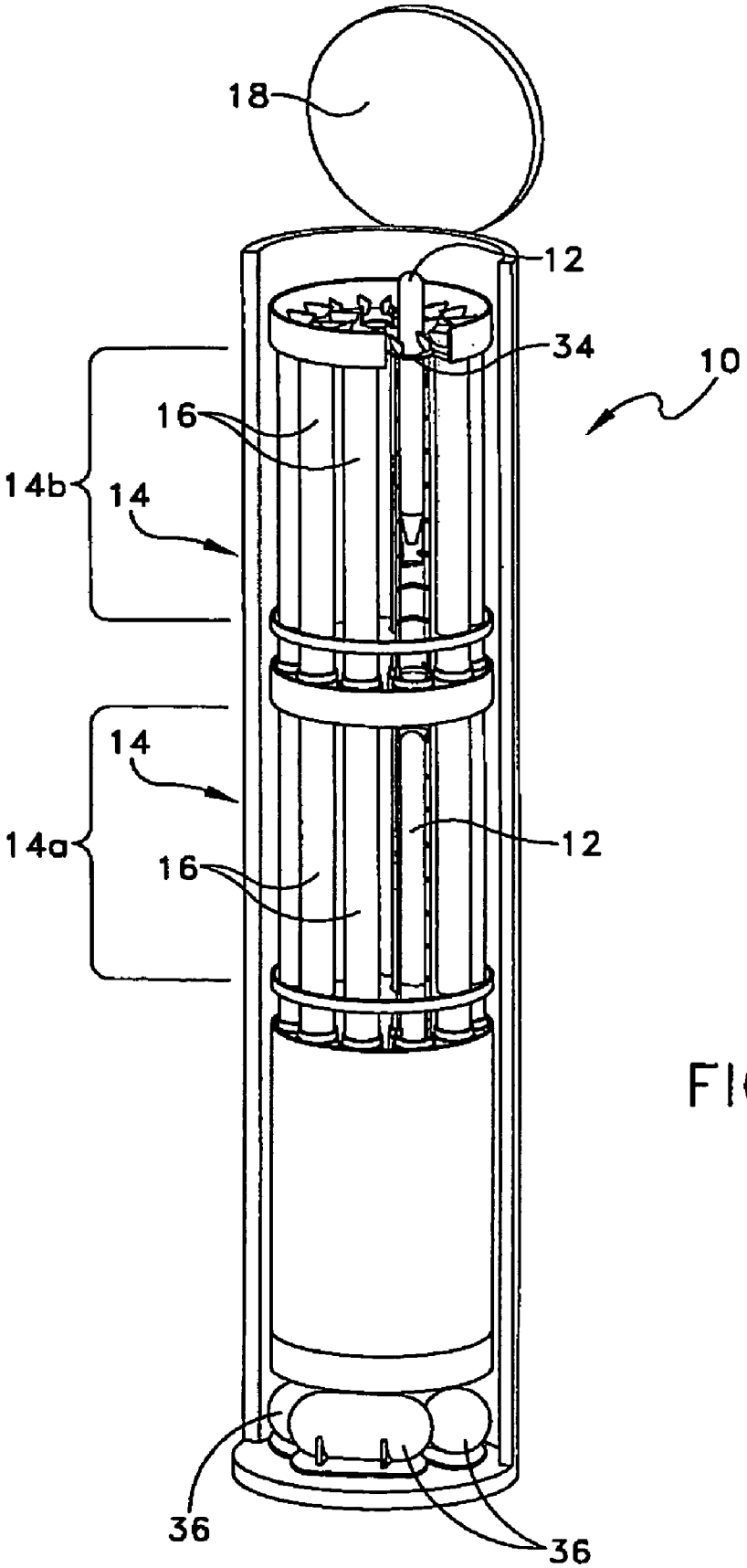
FIG. 1 is a perspective view of a missile module for the stackable, surface missile launch system according to the present invention.
Figure 2:
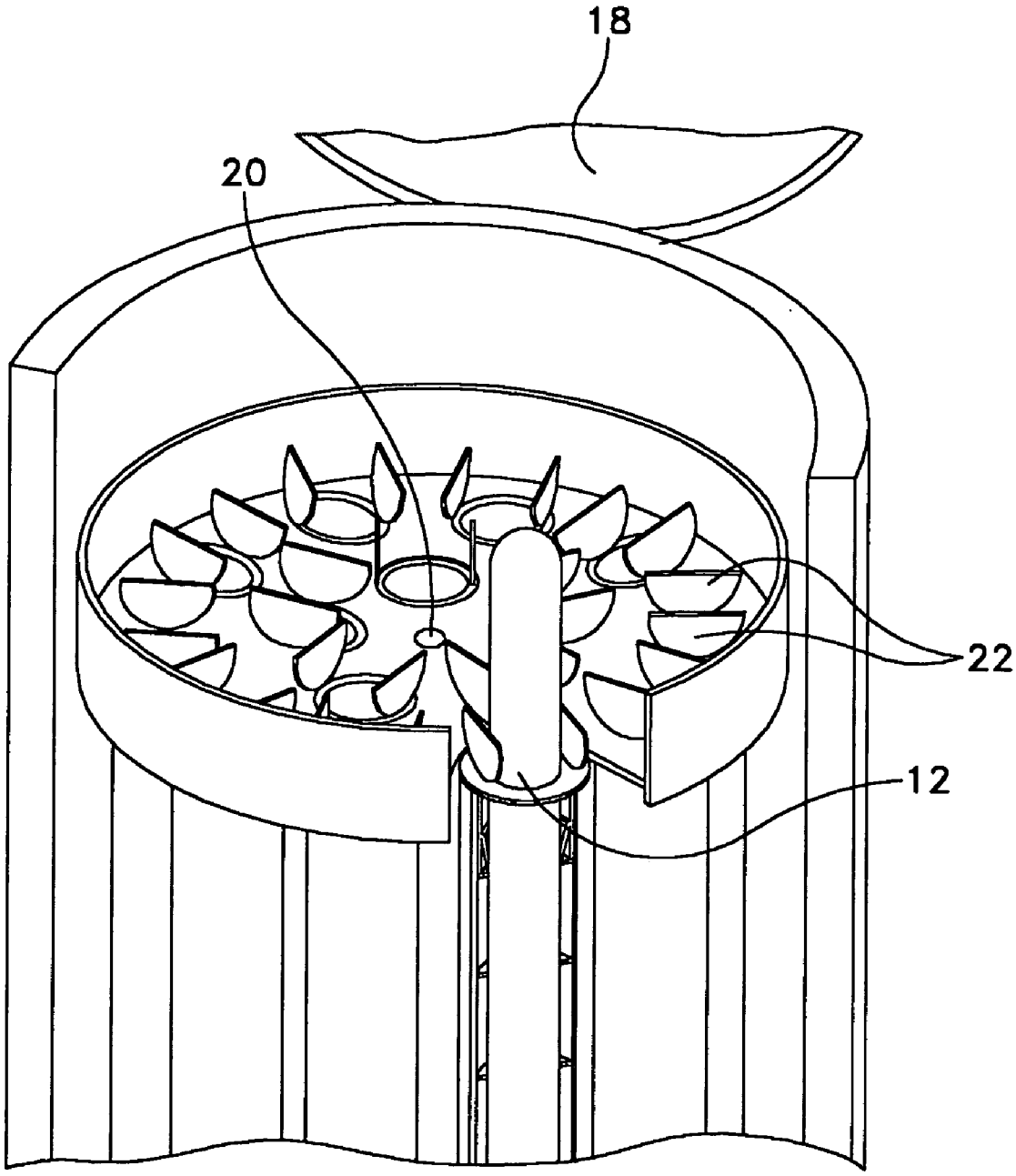
FIG. 2 is an enlarged perspective view of the launch end of the missile module of FIG. 1.
Figure 3:
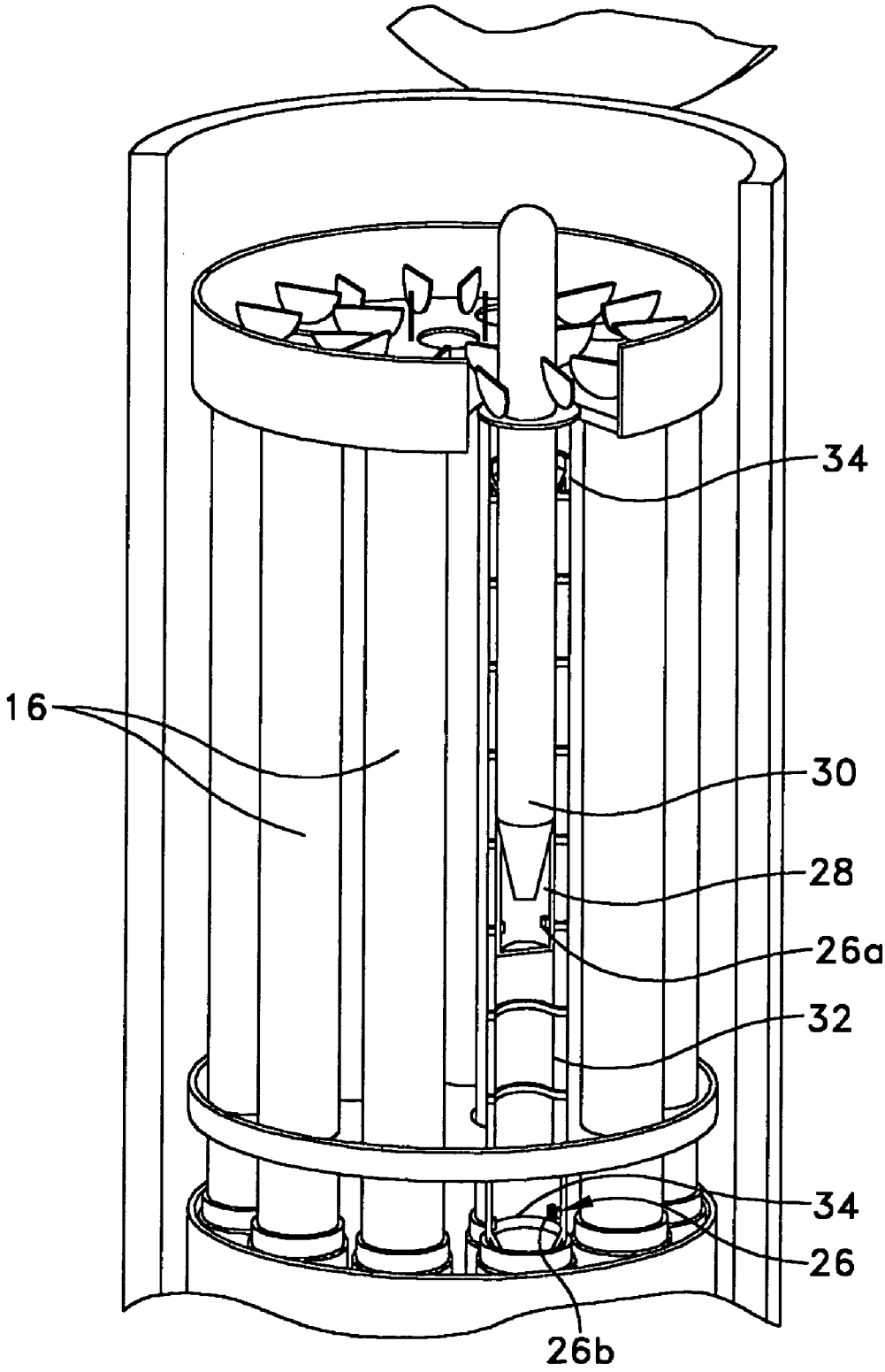
FIG. 3 is an enlarged perspective view of the launch end of the missile module of FIG. 1.

Referring now to the Figures, a payload pressure vessel 10 for supporting and launching a plurality of missiles 12 in a stackable, in-line configuration, from an underwater vehicle such as a submarine is illustrated. Each pressure vessel 10 may preferably contain one or more missile modules 14, each module 14 including multiple launch tubes 16, and each launch tube 16 housing at least one missile 12. The modules 14, or individual missiles 12, may be used alone or in groups stacked two or more high. The height of the pressure vessel 10 determines the number and height of modules 14 that can be stacked one on top of the other.

The pressure vessels 10 are preferably watertight and act to protect the missile modules 14 and missiles 12 from long-term exposure to corrosive seawater and from high depth pressures. The pressure vessel 10 remains closed with a watertight seal as the submarine maneuvers through the ocean environment. One or more lip seals 34 are preferably placed inside the launch tube 16 of each missile module 14. The lip seals 34 are designated to seal against the upper and lower portions of the missile 12 and limit the amount of pressurized air that leaks past the missile 12 during the launch event. The seals 34 may preferably be spaced vertically such that at least one seal 34 always remains in contact with the missile 12 during the launch. A bay door or hatch 18 is positioned at the upper or launch end of the vessel 10 and remains closed until a missile 12 launch is initiated. The interior of the pressure vessel 10 is preferably filled with air, whose pressure is dependent on the particular capabilities of the missiles 12 loaded within the pressure vessel 10. One example of a suitable pressure vessel 10 is a TRIDENT D5 tube, which is well known in the art.

Each missile module 14 preferably has a common size, shape, and payload of missiles 12 as the modules 14 disposed above and below it, and are substantially identical in construction. Each module 14 also preferably includes a common connection for power, communications, piping, and missile 12 alignment, all of which are well known in the art. When stacked two or more high, the missile launch tubes 16 of stacked modules 14 are connected and sealed to form a single long continuous missile tube. Flexible seals may be used at the base of each missile module 14 and launch tube 16 to minimize the mechanical connection requirements. Each launch tube 16 within a modular group preferably has the same height, and is vertically positioned to create a concave, or bowl shape at the top of the module 14. The bowl shape acts to funnel any seawater towards the middle of the module 14 where a drain 20 may preferably be located. The concave shape and drain 20 prevent standing seawater from collecting at the top of the module 14 and from leaking onto the missiles 12. The seawater drain 20 is also preferably sized to handle small amounts of water that may splash over the sides during high seas, when the submarine is surfaced and the watertight hatch 18 is opened.

Launch tubes 16 may each preferably include a hinged muzzle closure 22 disposed at the top, or launch end, which acts as a check valve to ensure that the high-pressure launch air travels in a single direction, up behind the missile 12. The muzzle closure 22 also acts to protect the missiles 12 disposed in a first or lower module 14*a* from the high-pressure air used to launch the missiles 12 above it in a second or upper module 14*b*, by preventing build up inside the launch tubes 16. Longitudinal gaps may also be provided along the length of the launch tubes 16 in order to allow a sufficient amount of air to pass by the missiles 12 and force the hinged muzzle closure 22 open as the missile 12 approaches the top of the launch tube 16. If the closure 22 is not open by the force of air it is free to open in the direction of missile 12 launch as the missile 12 makes contact with the muzzle closure 22. After a missile 12 has been launched, the muzzle closure 22 may remain open without adverse effect since each missile 12 has its own protective muzzle closure 22. However, a light torsion spring (not shown) and gravity may be utilized to close the hinged muzzle 22 after a missile 12 launch in order to protect the remaining internal components of the launch tube 16, such as the shock mitigation material 32 and the latching mechanism, described below.

A latching mechanism 26 is used to position the missile inside the modular launch tube 16 and is preferably designed as part of sabot 28. The latching mechanism 26 may preferably include a hinged portion 26*a* supported on the sabot 28, and a stop mechanism 26*b* supported on an interior surface of the launch tube 16. As a missile 12 is loaded into a launch tube 16, it is lowered to the point where the latching mechanism 26 engages the tube 16. The latching mechanism acts to prevent the missile 12 from dropping further down inside the launch tube 16. The latching mechanism 26 automatically releases the missile 12 as the force of pressurized air drives the missile 12 upwards. As will be appreciated, the latching mechanism 26 allows missile 12 motion upward, in the intended launch direction, but not downward. The hinged portion 26*a* preferably folds down to conform to the outside diameter of the sabot 28, so that the latching mechanism 26 will not interfere with the internal tube hardware as the missile 12 is launched. The hinged portion 26*a* of the latching mechanism 26 may preferably be discarded with the sabot 28 while the stop mechanism 26*b* preferably remains as part of the launch tube 16.

In the present embodiment, each missile 12 is preferably protected from the high-pressure air needed for ejection by sabot 28. Sabot 28 is positioned at the base 30 of the missile 12 and acts to prevent high-pressure air from traveling past the sabot 28 and reaching the missile 12 air frame which can damage the missile 12. The sabot 28 transfers the required launch force to the missile 12 without the missile 12 sensing the high-pressure launch air, or other gas. The latching mechanism 26 for the missile 12, and the module launch tube 16, is also preferably supported by the sabot 28. The outside diameter of the sabot 28 is preferably equal to that of the missile 12 in order to allow the sabot 28 to travel freely, with the missile 12, up through and out of the missile tube 16, as is known in the art.

The walls of the launch tubes 16 may preferably be lined with shock mitigation material 32 to provide shock protection for the missiles 12. The material 32 also compensates for small structural deformations that occur during missile tube 16 construction and during normal submarine depth pressure excursions. Preferably, the material 32 is thick enough to maintain sufficient contact with the missiles 12 to prevent free movement, but is not so thick as to adversely restrict the missile 12 from launching. A gap or clearance is preferably provided between the material 32 and the missile 12 to allow a controlled amount of air to pass ahead of the missile 12 and assist in opening the muzzle 22 closure.

In order to launch missiles 12, one or more air flasks 36 are supported at the bottom of the large payload pressure vessel 10 or payload bay. The air flasks 36 contain enough pressurized air (or gas) to launch all of the missiles 12 contained within the vessel 10. Because each missile module 14 may require a different amount of launch air or gas, the air flasks 36 may each be the same size with different pressures, or each flask 36 may be a different size with the same pressure. The lowest most missile module 14*a* will require the greatest amount of launch air, or gas, since its missiles 12 have the greatest distance to travel. Likewise, since the missiles 12 in the upper missile module 14*b* have the least distance to travel, they require the least amount of launch air, or gas. The air flasks 36 are preferably sized with enough reserve air such that all the missiles 12 can be launched without having to recharge the air flasks 36. Piping and valving internal to the module group may be used to distribute the air to the desired launch tube 16. Isolation valves at the flask 36 discharge and electromechanical valves at the base of each missile tube 16 may be used to control the discharge of air from the flasks 36, as is conventional.

Alternatively, other known devices may be utilized to launch the missiles 12, as would be known in the art. For example, gas generators may be used in place of the air flasks 36, or the missiles 12 could be hot launched using their own propulsion system. As with the air flasks 36, the gas generators should be sized according to the relative position of the missile modules 14 with the larger gas generators being used for the lower missile modules 14*a* and smaller ones being used for the upper missile modules 14*b*. Hot launching the missiles 12 would eliminate the need for air flasks 36 or gas generators and would also eliminate all launch debris. If hot launching is utilized, latching mechanism should preferably be formed as an integral part of the missile 12.

Use of the underwater missile launch system will now be described with reference to the FIGURES.

Initially, individual missiles 12 are loaded vertically into the modular launch tubes 16 until the hinged portion 26*a* on the sabot 28 is engaged. Unloading may be accomplished by releasing the latching mechanism and lifting the missile 12 and sabot 28 back out. The entire module 14 is then lowered into the payload bay or pressure vessel 10. Keyed alignments on the outside diameter of the modules 14 may be provided to ensure the modules 14 line up with one another as they are lowered in place. In particular, alignment is needed to allow for air pipe and electrical connections between modules 14. Once properly loaded, the missiles 12 are ready for launch.

To initiate launch, the submarine should be first positioned on the ocean surface. The hatch 18 of the pressure vessel 10 is then opened and the air flasks 36 are activated to emit pressurized air or gas. The pressurized air is sufficient to project the missile 12 and its sabot 28 through the launch tube 16 and out of the pressure vessel 10. The pressurized air may also be utilized to open the hinged muzzle closure 22 on the launch tube 16. Once ejected a sufficient predetermined distance, the missile sabot 28 is jettisoned and the missiles 12 own propulsion is activated to fly the missile 12 to its intended target. The sabot 28 falls back into the ocean as expendable debris. The process may then be repeated, as desired, for the remaining missiles 12.

It will be appreciated that the missile launch system disclosed herein provides an effective way of launching missiles 12 from a submarine which is low in cost to construct and operate, reliable, easy to maintain, and safe. In addition, the system increases packing density that allows submarines to carry larger payloads of missiles 12. Packing densities are increased by the ability to stack the missiles 12 two or more high within the same pressure vessel 10, and by launching more than one missile 12 from the same launch tube 16 thus reducing the amount of redundant hardware required per missile 12. Sharing a common pressure vessel 10, launch tube 16, and air flasks 36 also results in a significant cost and weight savings for the submarine. With increased payload packing densities, either more missiles 12 can be carried on the same size submarine or the same number of missiles 12 can be carried on a smaller submarine. The system also provides for easy loading and unloading of the missiles 12 and the missiles 12 can be loaded/unloaded individually or as an entire module 14.

It will be understood that many additional changes in the details, materials, steps and arrangement of parts, which have been herein described and illustrated in order to explain the nature of the invention, may be made by those skilled in the art within the principle and scope of the invention as expressed in the appended claims. For example, the sabot 28, as expendable launch debris, could be eliminated if the missiles 12 were capable of handling the required launch air pressures. If eliminating the sabot 28, the latching mechanism should be provided as an integral part of the missile.

What is claimed is:

1. An underwater missile launch system for launching one or more missiles from an underwater vehicle comprising:

a pressure vessel constructed and arranged to be supported on a hull of the vehicle;

one or more modules supported within said pressure vessel, each module including a plurality of launch tubes, the launch tubes being constructed and arranged to support a missile therein wherein the one or more modules comprise at least a first module and a second module, the second module supported on top of the first module such that the one or more launch tubes of the second module are substantially aligned with the one or more launch tubes of the first module and wherein the aligned tubes form a set of continuous launch tubes extending between the first and second modules;

a latching mechanism constructed and arranged to support the missile within the launch tube at a predetermined location, the latching mechanism preventing downward movement of the missile into the tube, while allowing for upward movement of the missile during launch.

2. The missile launch system of claim 1, wherein the first and second modules have substantially the same size, shape and payload of missiles.

3. The missile launch system of claim 1, further comprising a sabot disposed at a base of each missile.

4. The missile launch system of claim 3, wherein the latching mechanism includes a hinged portion supported on the sabot and a stop mechanism supported on an interior of each of the launch tubes.

5. The missile launch system of claim 4, wherein the hinged portion folds to conform to an outside diameter of the sabot.

6. The missile launch system of claim 1, further comprising one or more air flasks supported at the bottom of the pressure vessel, the air flasks constructed and arranged to provide pressurized air to launch tubes sufficient to launch the one or more missiles.

7. The missile launch system of claim 6, wherein each of the one or more air flasks contains a different amount of pressurized air.

8. The missile launch system of claim 1, further comprising a movable muzzle closure disposed at the launch end of each launch tube and constructed and arranged to prevent high-pressure air build up within the launch tubes.

9. The missile launch system of claim 1, further comprising a shock mitigation material disposed within each launch tube.

10. The missile launch system of claim 1, further comprising a hatch positioned at the upper end of the vessel.

11. An underwater missile launch system for launching one or more missiles from an underwater vehicle comprising:

a pressure vessel constructed and arranged to be supported on a hull of the vehicle;

at least a first module and a second module supported within said pressure vessel, the first and second modules each including a plurality of launch tubes, the second module supported on top of the first module such that the launch tubes of the second module are substantially aligned with the launch tubes of the first module;

a sabot disposed at a base of each missile; and a latching mechanism constructed and arranged to support each missile within its corresponding launch tube at a predetermined location, the latching mechanism preventing downward movement of the missile into the tube, while allowing for upward movement of the missile during launch, the latching mechanism further including a hinged portion supported on the sabot and a stop mechanism supported on an interior of each of the launch tubes.

12. The missile launch system of claim 11, wherein the first and second modules have substantially the same size, shape and payload of missiles.

13. The missile launch system of claim 11, wherein the hinged portion of the latching mechanism folds to conform to an outside diameter of the sabot.

14. The missile launch system of claim 11, further comprising one or more air flasks supported at the bottom of the pressure vessel, the air flasks constructed and arranged to provide pressurized air to launch tubes sufficient to launch the one or more missiles.

15. The missile launch system of claim 14, wherein each of the one or more air flasks contains a different amount of pressurized air.

16. The missile launch system of claim 11, further comprising a movable muzzle closure disposed at the launch end of each launch tube and constructed and arranged to prevent high-pressure air build up within the launch tubes.

17. The missile launch system of claim 11, further comprising a shock mitigation material disposed within each launch tube.

18. A method of launching a missile from an underwater vehicle comprising the steps of:

providing a pressure vessel constructed and arranged to be supported on a hull of the vehicle;

providing at least one missile;

providing a first module and a second module within said pressure vessel, the first and second modules each including a plurality of launch tubes;

loading the at least one missile within one of the plurality of launch tubes;

supporting the second module on top of the first module such that the launch tubes of the second module are substantially aligned with the launch tubes of the first module;

providing a latching mechanism constructed and arranged to support each missile within its corresponding launch tube at a predetermined location, the latching mechanism preventing downward movement of the missile into the tube, while allowing for upward movement of the missile during launch; and launching the missile from the launch tubes.

* * * * *